US006038733A

United States Patent [19]

Carder et al.

[11] Patent Number: 6,038,733

[45] Date of Patent: Mar. 21, 2000

[54] METHOD AND MEANS FOR INSTALLING CARPETS

[76] Inventors: William E. Carder, 4 Spyglass Hill Rd., Fairport, N.Y. 14450; Timothy Carder, 310 Cromwell Dr., Rochester, N.Y. 14610

[21] Appl. No.: 09/181,207

[22] Filed: Oct. 28, 1998

[51] Int. Cl.[7] ..... A47G 27/04

[52] U.S. Cl. ..... 16/16

[58] Field of Search ..... 16/4, 16

[56] References Cited

U.S. PATENT DOCUMENTS 3,254,361 6/1966 Brunn et al. ..... 16/16
4,653,138 3/1987 Carder ..... 16/4

FOREIGN PATENT DOCUMENTS 1136230 12/1968 United Kingdom ..... 16/16
1228767 4/1971 United Kingdom ..... 16/4
2221838 2/1990 United Kingdom ..... 16/16

*Primary Examiner*—Chuck Y. Mah
*Assistant Examiner*—Donald M. Gurley
*Attorney, Agent, or Firm*—Shlesinger, Fitzsimmons & Shlesinger

[57] ABSTRACT

An elongate, plastic housing has formed on the upper surface thereof two, spaced, parallel, longitudinally extending grooves the first of which has slidably positioned therein an elongate, metal, tackless carpet securing strip the opposed side edges of which extend slidably beneath elongate flanges that project from opposite sides of the first groove. Nails or the like are employed to secure the strips and the underlying portion of the housing to a floor, with the second groove facing upwardly to accommodate and secure therein the integral rib section of a conventional threshold insert. In a second embodiment a third groove is formed on the surface of the housing slidably to accommodate a second tackless carpet securing strip adjacent the side of the second groove remote from the first groove.

10 Claims, 2 Drawing Sheets

METHOD AND MEANS FOR INSTALLING CARPETS

BACKGROUND OF THE INVENTION

This invention relates to an improved method and means for installing carpets, and more in particularly this invention relates to an improved method and carpet fastening device for securing the edge or edges of carpets which terminate in a passageway or doorway.

In U.S. Pat. No. 4,653,138, which covers subject matter invented by one of the inventors herein—i.e., William E. Carder, there is disclosed a method of installing carpeting by employment of a wooden carpet securing strip which is secured to a floor, and which has thereon a plurality of carpet engaging projections extending from the face of the wooden strip. A plurality of rigid clips are then secured on the upper surface of the wooden strip at longitudinally spaced points therealong, each clip having in its upper surface a U-shaped recess for accommodating and retaining therein the rib section of an elongate threshold insert a portion of which overlaps and secures in place the edge of a carpet which overlies the wooden strip and the clips thereon.

In addition to the above, FIGS. 1 and 1A of the U.S. Pat. No. 4,653,138 patent also illustrate prior art devices then in use, and which disclose tackless-type carpet securing strips made from extruded aluminum or the like. Each one-piece extruded strip has projecting from its upper surface spaced, carpet-engaging teeth or projections which face in the direction of a generally U-shaped groove that extends along one side of the strip in order to accommodate the rib of a threshold insert of the type described above. This prior art includes extruded metal strips in which the U-shaped groove is positioned approximately medially of the strip, and the upper surface of the strip at each side of the U-shaped groove have carpet engaging teeth projecting from the upper surfaces thereof, the teeth along one side of the groove extending in one direction and the teeth along the opposite side of the groove extending in the opposite direction. This type of strip is designed to secure to the floor the confronting edges of two different sections of carpet.

One of the major problems encountered in the use of tackless-type carpet strips of the type described above is that the metal strips normally are extruded in extremely long sections, and therefore are difficult to transport and manipulate. Also since they are made from a metallic material, they tend to be rather heavy and expensive to manufacture.

It is an object of this invention, therefore, to provide an improved method and fastener device for securing the edges of carpet to a floor, and in particular where the edge of a carpet terminates at a doorway or passageway.

To this end, another object of this invention is to provide a novel retainer for a tackless-type carpet securing strip, the retainer being made from extruded plastic, or the like, having thereon at least two, separate, longitudinally extending grooves, one of which is adapted releasably to receive and retain therein a metal carpet securing strip of the type which has projecting from the face thereof a plurality of spaced, carpet engaging teeth projections, and the other of which grooves is designed to accommodate the rib of a conventional threshold insert.

Still another object of this invention is to provide an improved carpet retainer of the type described which is made from an extruded plastic material, or the like, and which has therein a first pair of longitudinally extending, laterally spaced grooves, each of which is disposed to have inserted therein an elongate, tackless-type, metal carpet securing strip, and a third groove which is interposed between the two first-named grooves, and is designed to have releasably secured therein the rib of an elongate threshold insert.

Other objects of the invention will be apparent hereinafter from the specification and from the recital of the appended claims, in particularly when read in conjunction with the accompanying drawings.

SUMMARY OF THE INVENTION

An elongate, plastic retainer housing has a plane, flat bottom wall, and a plurality of elongate, spaced, parallel wall sections integral with and projecting upwardly from the plane upper surface and forming thereon a plurality of longitudinally extending, parallel grooves. In one embodiment two such grooves are formed on the housing, one for securing therein a central rib formed on an elongate, conventional threshold insert, and the other groove disposed to have slidably inserted therein an elongate, tackless-type carpet securing strip. In a second embodiment the retainer housing has formed on its upper surface a third groove separated from said other groove by said one groove, and designed to have slidably inserted therein another tackless-type carpet securing strip.

THE DRAWINGS

FIG. 1 is a fragmentary plan view of an elongate, carpet fastener device of the type made according to one embodiment of this invention;

FIG. 2 is a slightly enlarged cross sectional view of this device as seen when taken along the line 2—2 in FIG. 1 looking in the direction of the arrows, the device being shown secured to a floor, and illustrating in phantom by broken lines a portion of a carpet overlying the associated carpet securing strip and having a marginal edge portion thereof secured beneath one edge of a threshold insert which is secured to the carpet strip;

FIG. 3 is a fragmentary plan view of a modified form of this novel carpet fastener device; and FIG. 4 is a slightly enlarged sectional view taken generally along the line 4—4 in FIG. 3 looking in the direction of the arrows, and illustrating in phantom by broken lines sections of carpet and certain of the nails that are employed to secure the device to a floor or the like.

DETAILED DESCRIPTION OF THE PREFERRED EMBODIMENTS

Figure 1:
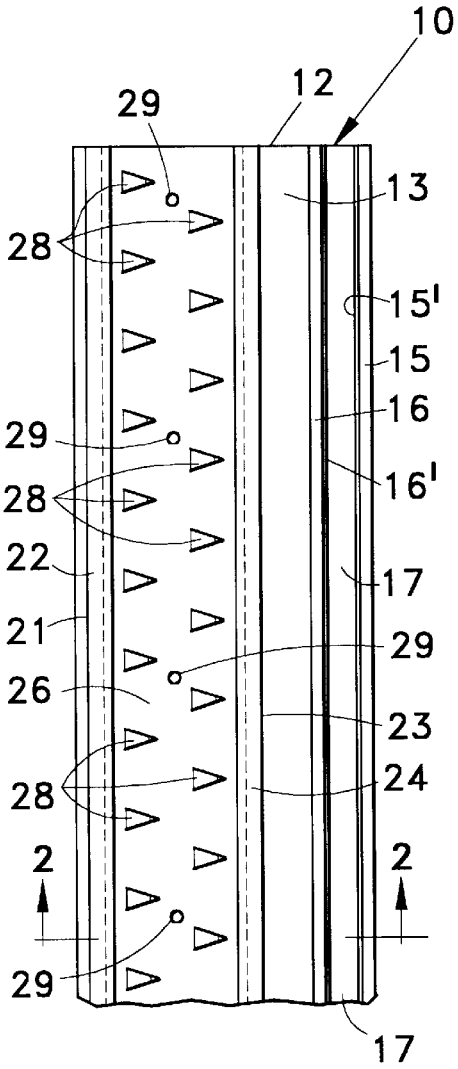
Figure 2:
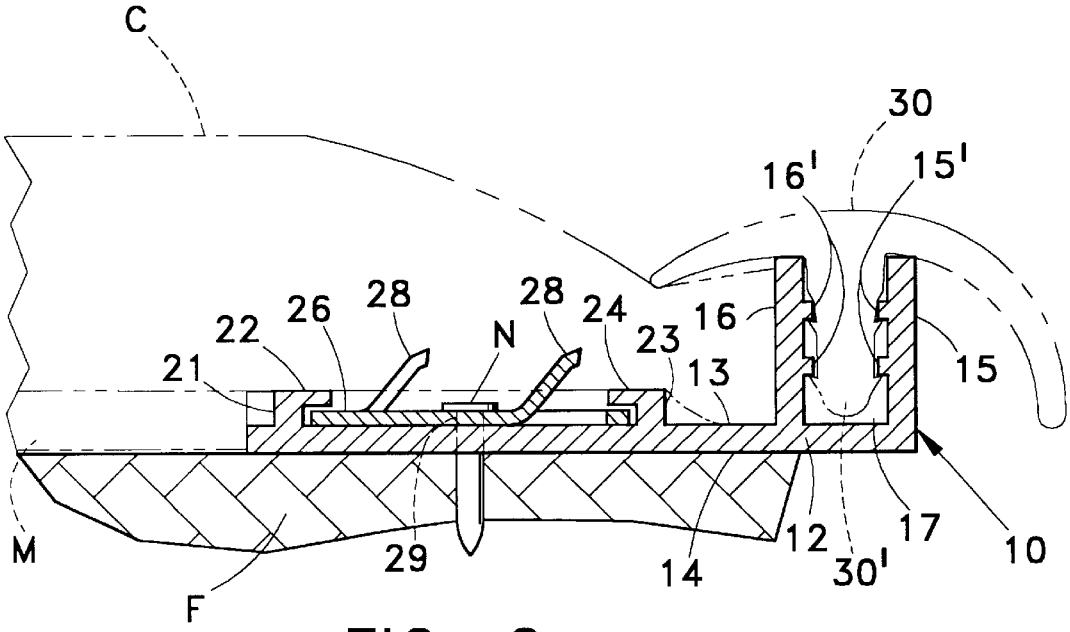

Referring now to the drawings by numerals of reference, and first to FIGS. 1 and 2, 10 denotes generally an elongated, extruded plastic retainer housing having a plane bottom wall 12 (FIG. 2) which is rectangular in configuration, and which has plane, parallel, top and bottom surfaces 13 and 14, respectively. Integral with and projecting at right angles upwardly from the upper surface 13 of wall 12 adjacent one side thereof (the right side as shown in FIG. 2) are two spaced, parallel, upstanding wall sections 15 and 16, which extend longitudinally of the housing 10 between opposite ends thereof, and which form therebetween a generally U-shaped groove 17 for a purpose noted hereinafter. Wall section 15 has formed on the surface thereof facing wall section 16 a pair of spaced, parallel, longitudinally extending ribs 15' which are spaced from and register with a similar pair of ribs 16' formed on the confronting surface of wall section 16.

Integral with and projecting slightly above the surface 13 of wall 12 along the side thereof remote from the wall section 15 is a first rib section 21. Section 21 has a narrow, laterally extending flange portion 22 which extends inwardly toward the center of housing 10 and overlies, and is disposed in spaced, parallel relation to, a marginal portion of the surface 13. Also integral with and projecting slightly above the surface 13 in spaced, parallel relation to the rib section 21 is a second rib section 23 having on the upper end thereof an integral, laterally extending flange section 24 disposed in spaced, confronting relation to the flange 22, and in spaced, parallel overlying relation to a marginal portion of surface 13 of wall 12.

Spaced, parallel rib sections 21 and 23 on housing 10 form therebetween on the upper surface 13 of wall 12 an elongate groove in which is slidably positioned an elongate, rectangular, metal carpet securing strip 26, which may be of conventional design. The upstanding rib sections 21 and 23 of housing 10 are spaced to each other a distance only slightly larger than the overall width of the strip 26, whereby opposed, longitudinally marginal side portions of strip 26 are positioned slightly beneath the flange section 22 and 24 of the rib sections 21 and 23. Because of this construction the overlying flange sections 22 and 24 of the rib sections 21 and 23 prevent removal of any portion of the strip 26 from the groove defined by the rib sections 21 and 23 except by sliding movement of the strip 26 into or out of one end or the other of the groove defined by the sections 21 and 23. Also, as shown in FIG. 2, when the strip 26 is inserted between sections 21 and 23 the plane, flat underside of the strip 26 rests in coplanar relation with the upper surface 13 of wall 12, while the numerous, upstanding projections or teeth 28, which form part of a conventional strip 26, project diagonally upwardly above the rib section 23 and face, generally, in the direction of the groove 17 defined by the wall sections 15 and 16.

In use, the plastic housing 10, which may be made from a polyvinyl chloride plastic (PVC), may also be made in any desired length, since it is a relatively simple matter to cut a respective length of the housing 10 to a desired length. Housing 10 is particularly suited for use in those instances where a carpet is to terminate in a door or a passageway, and it is desired to prevent anyone from accidentally tripping over the edge of the associated carpet. In such case the housing 10 is cut to the desired length, and an elongate section of the metal carpet securing strip 26 is inserted into the groove defined between the rib sections 21 and 23. The housing 10 and the associated strip 26 are then positioned on the surface of a floor F (FIG. 2) or the like with the groove 17 extending adjacent to and transversely across the edge of a doorway, or the like. The fastener device, in the form of the housing 10 and strip 26, is then secured to the floor F by a series of nails, each of which has a shank thereof driven through one of a series of spaced openings 29 formed in the strip 26, and through the underlying portion of wall 12 of the housing and into the floor F. After the plastic housing 10 and carpet securing strip 26 have been secured on the floor F adjacent one edge of a carpet mat M, an associated edge of the carpet C (broken lines in FIG. 2) is inserted over the upstanding teeth 28 on the strip 26, and has the marginal edge thereof inserted in the space between shoulder 23 and the wall section 16. This edge of the carpet is secured beneath one longitudinally extending side edge of a conventional, elongate threshold insert 30 (broken lines in FIG. 2), which has formed thereon between its longitudinally side edges an integral rib section 30', which extends downwardly into the groove 17 and is secured in a conventional manner therein by the ribs 15' and 16' on the wall sections 15 and 16.

One of the primary advantages of the above-noted retainer housing 10 and the associated carpet securing strip 26 is the fact that the housing 10 is rather inexpensive to manufacture, can easily be cut into any desired length, and is easy to transport. Moreover it can be employed in a variety of different lengths in which case, for example, one or more such lengths can be placed end to end to accommodate releasably therein a metal carpet securing strip 26, in which case one elongate strip 26 could be disposed within several separate sections of housing 10 which thereafter could be secured to a floor or the like. This constrasts with the metal strips 26 which normally are produced in rather long, rather heavy and difficult to handle lengths.

Figure 3:
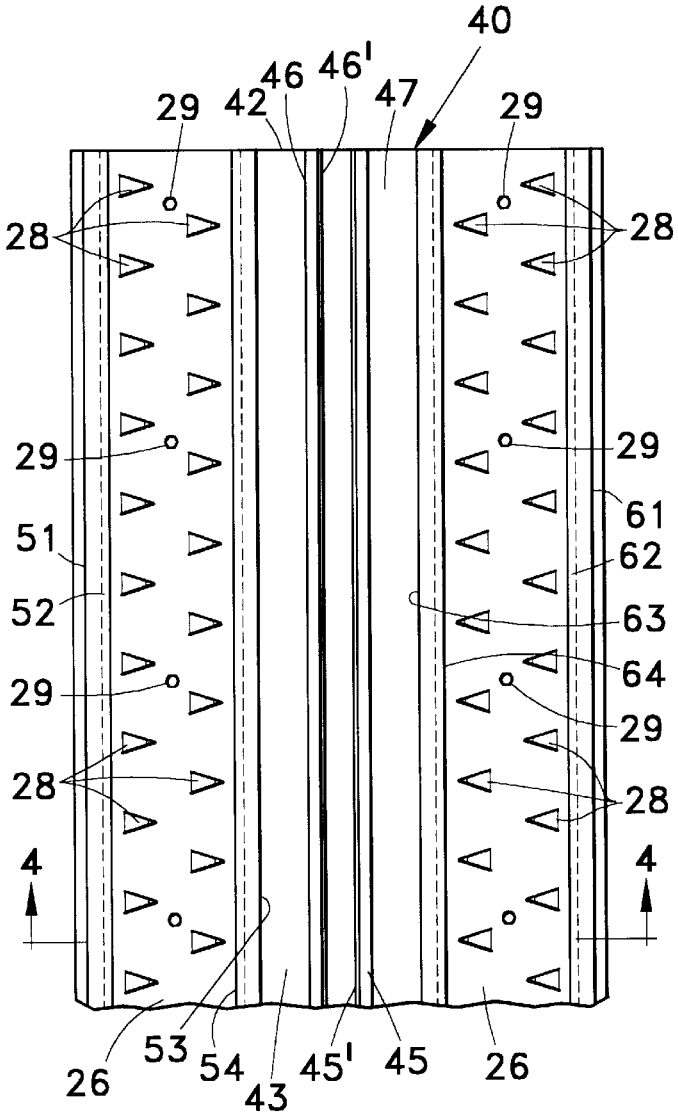
Figure 4:
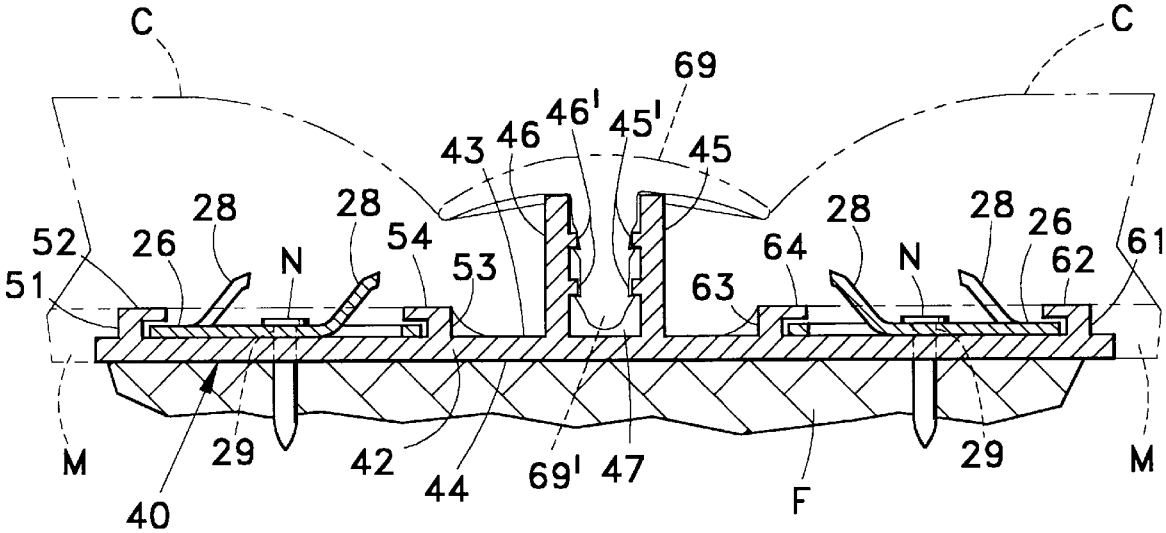

Referring now to the embodiments shown in FIGS. 3 and 4, wherein like numerals are employed to denote the elements similar to those employed in the first embodiment, 40 denotes generally an elongate, plastic retainer which is generally rectangular in configuration when viewed in plan. Housing 40 comprises a plane, flat bottom wall 42 having formed thereon plane, flat, parallel upper and lower surfaces 43 and 44, respectively. Integral with and projecting at right angles upwardly from the upper surface 43 of the wall 42 are two, spaced, parallel, longitudinally extending wall sections 45 and 46 which form therebetween a groove 47 which is disposed medially of the opposed side edges of housing 40. As in the first embodiment the confronting surfaces of wall sections 45 and 46 have thereon a pair of spaced, parallel, registering, longitudinally extending ribs 45' and 46', respectively. Unlike the first embodiment, the groove 47 is formed down the center of wall 42 medially of the opposed side edges of wall 42, rather than being formed along one longitudinal side edge thereof as in the first embodiment. The advantage of this construction, as noted hereinafter, is that it enables two spaced, parallel, longitudinally extending carpet securing strips 26 to be mounted on the upper surface 43 of wall 42 adjacent opposite sides, respectively, of the wall sections 45 and 46.

For example, integral with each of the two opposed, longitudinally side edges of wall 42 and projecting slightly above its upper surface 43 are two longitudinally extending, parallel rib sections 51 and 61, respectively. The sections 51 and 61 have integral therewith narrow, laterally extending flange portions 52 and 62, respectively, which extend slightly inwardly toward the center of housing 40, and which overly and are disposed in spaced, parallel relation to marginal portions of the upper surface 43 of wall 42. Integral with and projecting slightly above surface 43 in the space between rib 51 and the wall section 46 is another, longitudinally extending rib section 53, which is disposed in spaced, parallel relation to rib section 51, and which has integral with the upper end thereof a laterally extending flange section 54 which extends toward and is disposed in spaced, confronting, parallel relation to flange section 52. Rib sections 51 and 53 and their associated flange sections 52 and 54, respectively, thus form on the surface 43 of wall 42 a first groove which is disposed to have inserted therein a carpet securing strip 26 in the manner similar to that in which the strip 26 is disposed on surface 13 of the first embodiment.

Adjacent the opposite side of housing 40 in the space between wall section 45 and the rib section 61, another integral, longitudinally extending rib section 63 projects slightly above surface 43 and has on the upper end thereof an integral, longitudinally extending flange section 64 which extends towards, and is disposed in spaced, confronting, parallel relation to the flange 62 on section 61. Again, as in the manner shown in FIG. 2, the two flange sections 62 and 64 form on surface 43 another longitudinally extending groove disposed to have inserted therein an elongate carpet securing strip 26 similar to that shown in the first embodiment. As shown in FIG. 3 each of the two strips 26 mounted on housing 40 have therethrough a series of spaced openings 29 for accommodating the shanks of nails N are employed to secure this modified fastener device, including the housing 40 and two associated strips 26, to a floor F between the spaced confronting edges of two carpet supporting mats M. The advantage of this modified fastener device is that two opposed, confronting edges of two different sections of carpet C can be secured over the projections 28 of the two strips 26, and beneath the opposed overlying, longitudinally extending edges of a conventional threshold insert 69, which like the insert 30 shown in FIG. 2, has an integral, centrally disposed rib 69' which is releasably secured in the groove 47 between the wall sections 45 and 46 by their respective ribs 45' and 46'.

From the foregoing it will be apparent that the present invention provides a relative simple and inexpensive method and means for securing the edges of carpeting to a floor or the like, and in particular when such carpet is to be installed across a doorway or passageway. By utilizing the relatively light, plastic retainer housings 10 and 40 it is possible to produce or sever such housings into a variety of different lengths and one or more of such housings can be utilized to accommodate an elongate, metal carpet securing strip, or two such strips in the case of the second embodiment.

Moreover, while this invention has been illustrated and described in detail in connection with only certain embodiments thereof, it will be apparent that it is capable of still further modification, and that this application is intended to cover any such modifications that may fall within the scope of one skilled in the art or the appended claims.

We claim:

1. A retainer for a tackless-type carpet securing strip employed for fastening carpet to a floor or the like, comprising an elongate retainer housing having a plane bottom surface and a plane upper surface extending parallel to said bottom surface, a first pair of spaced, parallel, longitudinally extending wall sections integral with and projecting above said upper surface and forming therebetween on said housing a first longitudinally extending groove, a second pair of spaced, parallel, longitudinally extending wall sections integral with and projecting above said upper surface and forming therebetween on said housing a second longitudinally extending groove parallel to and laterally spaced from said first groove, and each of said second pair of wall sections having thereon an elongate, integral flange portion extending laterally therefrom part way toward the center of said second groove and in spaced parallel, confronting relation to each other and to marginal portions of said upper surface adjacent opposite sides, respectively, of said second groove, said housing disposed to have an elongate carpet securing strip slidably inserted into said second groove with marginal portions along the opposed side edges of said strip extending slidably beneath said flange portions of said second pair of wall sections.

2. A retainer as defined in claim 1, wherein said first pair of wall sections project equi-distantly above said upper surface of said housing for a distance greater than that of said second pair of wall sections.

3. A retainer as defined in claim 2, wherein said housing is made of plastic material.

4. A retainer as defined in claim 1, wherein said first pair of wall sections are located medially of the longitudinal side edges of said housing and in laterally spaced relation to said second pair of wall sections, a third pair of spaced, parallel, longitudinally extending wall sections are integral with and project above said upper surface and form therebetween on said housing a third longitudinally extending groove parallel to and laterally spaced from said first groove at the side thereof remote from said second groove, each of said third pair of wall sections has thereon an elongate, integral flange portion extending laterally therefrom part way toward the center of said third groove, and in spaced, confronting relation to each other and to marginal portions of said upper surface adjacent opposite sides, respectively of said third groove, and said housing is disposed to have a further, elongate carpet securing strip slidably inserted into said third groove with marginal portions along the opposed side edges of said further strip extending slidably beneath said flange portions on said third pair of wall sections.

5. A retainer as defined in claim 1, wherein said housing has opposed, longitudinally extending side edges, one wall of one of said pair of wall sections extends along one longitudinal side edge of said housing, and one wall of the other pair of wall sections extends along the other longitudinal side edge of said housing.

6. A retainer as defined in claim 1, wherein said first pair of wall sections have thereon spaced, parallel confronting surfaces forming opposite sides of said first groove, and each of said confronting surfaces of said first pair of wall sections has projecting therefrom a plurality of spaced, parallel, longitudinally extending ribs.

7. A device for fastening the edge of a carpet to a floor, comprising an elongate plastic housing including a bottom wall having plane, parallel, bottom and upper surfaces, respectively, two pairs of spaced, parallel, longitudinally extending wall sections integral with and projecting above said upper surface of said wall, each of said pairs of wall sections forming between the confronting surfaces thereof a groove extending longitudinally of said housing, one of said pairs of wall sections having projecting from said confronting surfaces thereof lateral flanges disposed in spaced, parallel confronting relation to each other and to marginal portions of said upper surface, of said housing, an elongate, metal, tackless carpet securing strip slidably inserted onto said upper surface of said housing in the groove formed between said one pair of wall sections, said strip having opposed, marginal side portions thereof extending slidably beneath said lateral flanges, and means for securing said strip and the underlying portion of said housing to a floor.

8. A device as defined in claim 7, wherein each of said confronting surfaces of the other of said two pairs of wall sections has projecting therefrom a plurality of spaced, parallel, longitudinally extending ribs.

9. A device as defined in claim 8, including a third pair of spaced, parallel wall sections projecting from the upper surface of said wall in spaced, parallel to said other pair of wall sections and at the side thereof remote from said one pair, a second, elongate, metal, tackless carpet securing strip slidably inserted on the upper surface of said wall with the opposed side edges thereof facing the confronting surfaces of said third pair of wall sections, said confronting surfaces of said third pair of wall sections having integral therewith and projecting therefrom lateral flanges which overlie the opposed side edges of said second strip, and means for securing said second strip and the underlying portion of said housing to a floor.

10. A method of installing carpet of the type in which at least one edge of the carpet is secured to a floor by the teeth of an elongate tackless carpet securing strip and, an elongate threshold insert having a curved upper section and an integral, downwardly projecting rib section comprising providing an elongate retainer housing having two pairs of spaced, parallel, longitudinally extending wall sections projecting above an upper surface thereof, one of said pairs of wall sections having projecting from the confronting surfaces thereof lateral flanges disposed in spaced, parallel, confronting relation to each other and to marginal portions of said upper surface of the housing, slidably inserting a tackless carpet securing strip onto the upper surface of said housing between said one pair of wall sections with opposed marginal side portions of said strip extending slidably beneath said lateral flanges, securing said strips and said housing to a floor, securing a marginal portion of a carpet adjacent one edge thereof to the teeth of said strip, and securing said rib section of a threshold insert in the space between the two wall sections of the other pair thereof so that a portion of said upper section of said insert overlies said one edge of said carpet.

* * * * *